United States Patent [19]

Donnelly

[11] 4,402,487

[45] Sep. 6, 1983

[54] JACK FOR LIFTING UNBALANCED LOADS

[76] Inventor: Raymond C. Donnelly, Imperial Gardens, Bldg. 50, Apt. 1C, Wappinger Falls, N.Y. 12590

[21] Appl. No.: 261,056

[22] Filed: May 6, 1981

[51] Int. Cl.[3] ..... B66F 3/00

[52] U.S. Cl. ..... 254/133 R; 254/DIG. 1; 254/DIG. 4; 254/101

[58] Field of Search ..... 254/133, 134, 2 B, 101, 254/DIG. 1, DIG. 4; 248/356, 352, 160, 599; 16/44

[56] References Cited

U.S. PATENT DOCUMENTS

| | | | |
|---|---|---|---|
| 785,455 | 3/1905 | Vigie | 254/DIG. 4 |
| 995,583 | 6/1911 | Willour | 254/133 R |
| 2,060,543 | 11/1936 | White | 254/DIG. 1 |
| 2,119,028 | 5/1938 | Schmidt et al. | 254/111 |
| 2,198,270 | 4/1940 | Maranville | 16/44 |
| 2,909,358 | 10/1959 | Southerwick | 254/2 B |
| 2,951,679 | 9/1960 | Volkert | 254/111 |
| 3,765,650 | 10/1973 | Eisenhauer | 254/133 R |
| 4,025,053 | 5/1977 | Stickle | 254/DIG. 4 |
| 4,084,791 | 4/1978 | Margueratt | 254/101 |
| 4,101,036 | 7/1978 | Craig | 248/356 |

*Primary Examiner*—Robert C. Watson

*Attorney, Agent, or Firm*—Spellman & Joel

[57] ABSTRACT

A jack for lifting unbalanced loads such as automobiles, comprises a base having a raised portion thereon with a recess therein to accommodate the base of a jack column. The recess for the jack column is offset on the base and oriented to place a major portion on the base beneath the jack saddle during operation in order to increase stability. A substantially circular collar is mounted about the jack column at a predetermined distance from the base, said collar being supported by a plurality of spaced flexible legs pivotally mounted to the base at one end and curving upwardly to a removable mounting at the collar to prevent column tilt. The jack also includes a saddle assembly having a movable saddle with a protruding portion to engage an aperture in the load which is oriented to approximate the direction of lift point shift. The saddle is free to move perpendicular to the column against the action of a spiral spring when a load is applied and its rotational motion about the column is resiliently restrained by spring means. Thus, the two elements of lift point shift, magnitude and direction, cause compensating movements in the saddle assembly to increase stability, and thereby improve functional reliability and operational safety.

8 Claims, 11 Drawing Figures

JACK FOR LIFTING UNBALANCED LOADS

BACKGROUND OF THE INVENTION

This invention relates to lifting mechanisms and particularly to new and improved jack arrangements which increase stability during operation.

In the lifting of unbalanced loads with a jack, and particularly cars and trucks, the weight of the vehicle is not equally distributed about the jack saddle or lift point. During operation, the unequal weight distribution causes the vehicle to tilt as one wheel is raised and the other three remain on the ground. This tilting causes a shift in the lift point related to the vehicle's suspension design and the ratio of wheel base to track.

Current bumper jacks accommodate lift point shift by a loose fit between the column and pedestal. The loose fit allows the column to tilt as the jack is operated. The weight of the vehicle, however, is applied to the jack base at an off-perpendicular angle which may be resolved into horizontal and vertical components. If an impact or force is applied to the vehicle during lifting, an additional shift of the lift point occurs and tilt of the column is increased. The horizontal component of the weight supported by the jack then becomes sufficient to overcome the friction between the jack base and the ground. The base then slips horizontally and the vehicle falls from the jack.

This invention is designed to prevent jack failure during lifting. In addition to impacts applied to the wheel, failure may occur due to leaning on the side of the vehicle, slamming a door, or using a lug wrench to loosen or tighten a wheel. The probability of slippage will also be increased if the jack column is not initially positioned perpendicular to the base. In the invention, column tilt is prevented by a novel base design while a new and improved saddle assembly accommodates lift point shift. The saddle assembly absorbs and dissipates the effects of all but the most severe extraneous impacts.

The prior art includes U.S. Pat. No. 3,232,584 to J. C. Miles which shows a folding base member for a screw-type jack having straight pivotally mounted legs or support members that are carried by the base plate and which have connected to the upper legs thereof an anchor boss for supporting the vertical jack column. The base member and the leg members are different in configuration and operation from the arrangements set forth herein. Neither the leg members nor the base of the Miles patent permit the flexing within defined limits which is possible with the present invention. The patent also fails to disclose a saddle which compensates for the elements of lift point shift during normal operation and the problems arising from impacts or unusual forces which are unanticipated. A conventional flat screw head is the lifting element in the Miles patent.

U.S. Pat. No. 3,184,205 to L. J. Carpezzi discloses a base member having curved legs which support the lower portion of the jack column at their upper ends. The leg members of the patent, however, are mounted in a rigid manner to the base and the curve of the legs is opposite to the configuration proposed herein. The base as shown in Carpezzi is a flat wheeled member having a central aperture. The Carpezzi patent thus differs substantially from the present structure and completely fails to disclose a saddle of the type to which a claim of novelty is directed herein.

The prior art also includes U.S. Pat. No. 2,502,037 to J. Erikainen on a vehicle bumper jack, U.S. Pat. No. 2,960,308 to H. J. O'Donnell on a telescopic jack, and U.S. Pat. No. 3,493,209 to R. C. Brammer on a stabilizing jack base. These patents are quite different from the present invention and are merely cited to be of interest for the general disclosures contained therein.

In summary, other patents may, of course, exist and be pertinent, but the above represents a cross-section of the best prior art of which applicant is aware. None of the references disclose the unique combination of features proposed herein. It appears, therefore, that the invention is patentable.

SUMMARY OF THE INVENTION

This invention relates to portable lifting mechanisms and particularly to jacks for lifting unbalanced loads such as automobiles.

In the invention, a conventional ratchet-rack jack assembly includes a column which is mounted at one end in a base having a raised portion thereon with a recess to accommodate said column. The jack column includes a unique jack saddle which engages the rack on the jack column and is ratcheted therealong to lift the load. The recess for the jack columm is offset on the base and oriented to place a major portion of the base beneath the jack saddle during operation in order to increase stability. The saddle also includes means to accommodate lift point shift by compensating motions in the saddle assembly.

More specifically, a substantially circular collar is mounted about the jack column at a predetermined distance from the base and is supported by a plurality of spaced flexible legs. The legs comprise curved metal rods pivotally mounted to the base at one end and extending upwardly therefrom. In a typical embodiment involving three legs, two of the flexible legs fit within a collar hole at their upper end while the third leg is pivotally connected to the collar. The jack is readily stored by merely removing the two legs from the collar holes and collapsing the assembly.

The jack saddle assembly includes a removable saddle with a protruding portion which fits into a recess in the bottom of a bumper. The recess is oriented to approximate the direction of lift point shift and compensate therefor. The saddle is keyed to a saddle support which in turn is coupled to the jack column in a conventional ratchet-rack arrangement. The saddle is free to move longitudinally along the saddle support against the action of a spiral spring when a load is applied. Horizontal rotation of the saddle assembly about the column is permitted by a straight wire spring which opposes the forces imparted to the saddle. As the jack is operated, the two elements of lift point shift, magnitude and direction, cause compensating motions in the saddle assembly.

Alternate embodiments of the invention directed to floor jacks are also disclosed herein and incorporate the features of the unique saddle arrangement.

Accordingly, an object of this invention is to provide a new and improved jack which compensates for lift point shift.

A further object of this invention is to provide a new and improved lifting mechanism, such as a jack, which includes a new type base which is readily collapsible for storage purposes and restricts shifting of the jack column during operation.

A still further object of this invention is to provide a new and improved jack including a saddle assembly which compensates for elements of lift point shift such as magnitude and direction, by causing compensating motions in the saddle assembly.

A more specific object of this invention is to provide a new and improved jack having a unique base and support to restrict movement of the jack column during operation or impact and a saddle assembly having a saddle thereon which is free to move, thereby compensating for operational forces which would otherwise cause column movement or tilt.

BRIEF DESCRIPTION OF THE DRAWINGS

Other objects and advantages of this invention may be seen from the following description when viewed in conjunction with the accompanied drawings wherein.

DETAILED DESCRIPTION OF THE INVENTION

Figure 1:
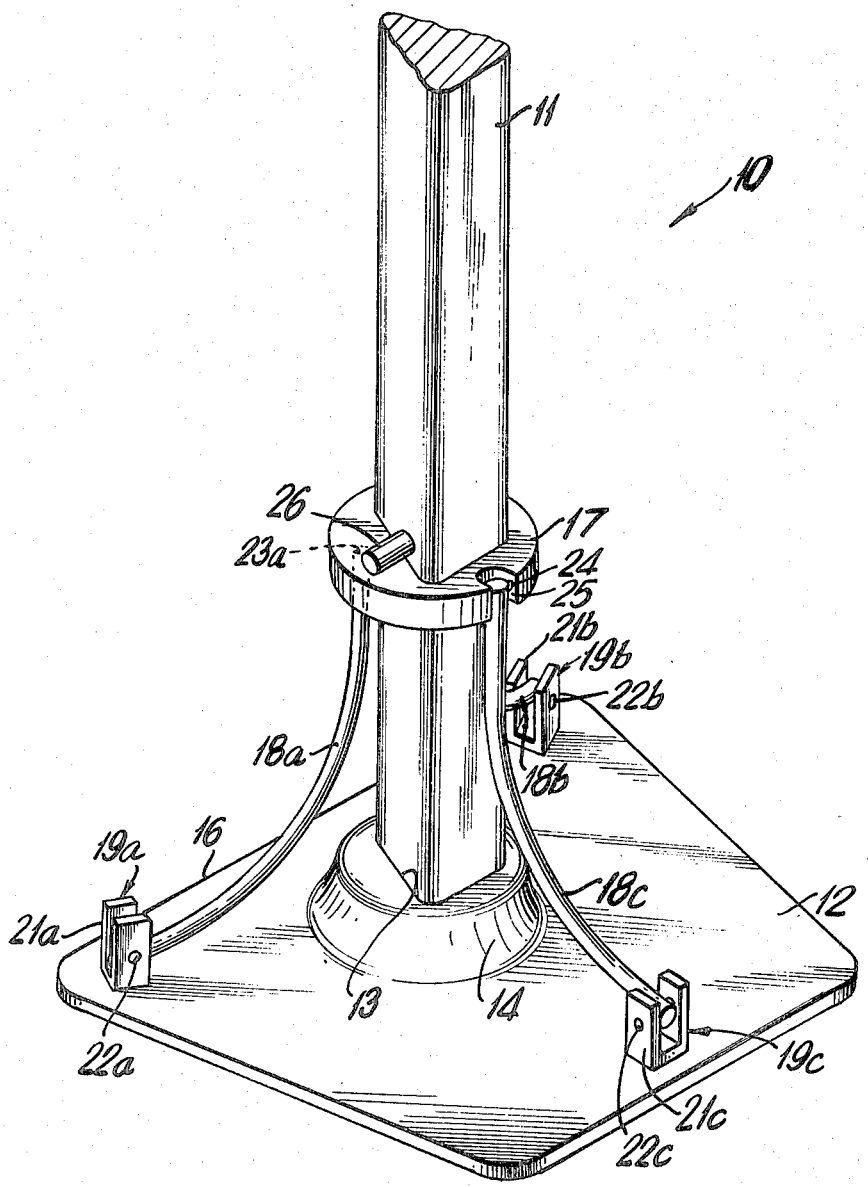
FIG. 1 is a perspective view of the jack arrangement comprising the invention.
Figure 2:
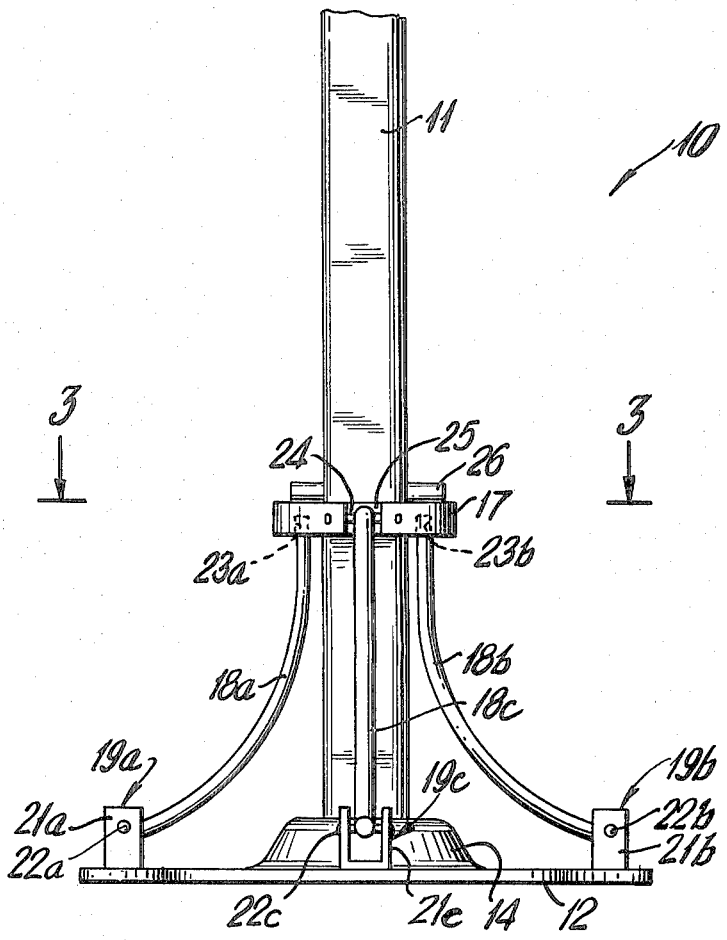
FIG. 2 is a front view of the subject invention.
Figure 3:
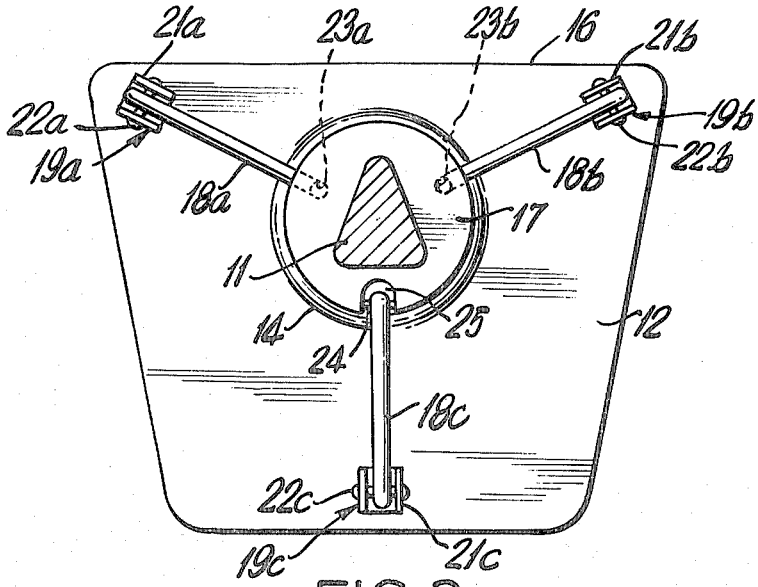
FIG. 3 is a view taken along the line 3—3 of FIG. 2.

Referring now to the drawings, the invention comprises a jack assembly 10 which includes a column 11 which is mounted on base 12. The column 11 has a substantially triangular cross-sectional shape as shown in FIG. 3 which engages the recess 13 in the raised portion 14 of the base 12. The raised portion 14 is positioned towards the longer edge 16 so that a major portion of the base 12 is positioned beneath the jack saddle 15 during operation to increase stability.

The column 11 and the jack saddle 15 are operatively engaged in a conventional ratchet-rack coupling and hence will not be described in detail herein except to the extent necessary for an understanding of the present invention. The preferred embodiment relates to a bumper-type jack with alternate embodiments relating to floor jacks and the like.

The jack column 11 is surrounded by a collar 17 to restrict the movement of the column 11 during operation. The collar 17 is coupled to the base by leg members 18*a–c* which are pivotally connected to the base 12 at one end by couplings 19*a–c* respectively. The couplings 19*a–c* comprise vertically extending members 21*a–c* having a U-shaped configuration at the upper end thereof and a pin 22*a–c* running transversely thereacross in order to accommodate an aperture in the legs 18*a–c*. The legs, 18*a* and 18*b*, are mounted in respective collar holes 23*a, b* at their upper end while leg member 18*c* is hinged to a pin 24 within recess 25 in the collar 17.

The legs 18*a–c* are shaped in a concave configuration in order to minimize the movement of the jack column 11 during lifting. The weight of the vehicle or load is first absorbed by the legs 18*a–c* which flex as the load is applied. The leg members 18*a–c* may be readily released from the holes in the collar 17 and collapsed to permit storage of the jack assembly 10. In an alternate arrangement (not shown) the legs 18*a–c* may be permanently affixed to the base 12 and collar 17.

The pin 26 in the column 11 prevents the column 11 from bottoming in the base recess 13 initially. As mentioned above, the weight of the load is first absorbed by the legs 18*a–c* which flex as the weight increases during lifting. The column 11 finally bottoms in the base recess 13 and this flexion applies force at the points of contact between the legs 18*a–c* and the base 12 and collar 17 which imparts sufficient rigidity to the assembly to prevent column tilt.

Figure 4:
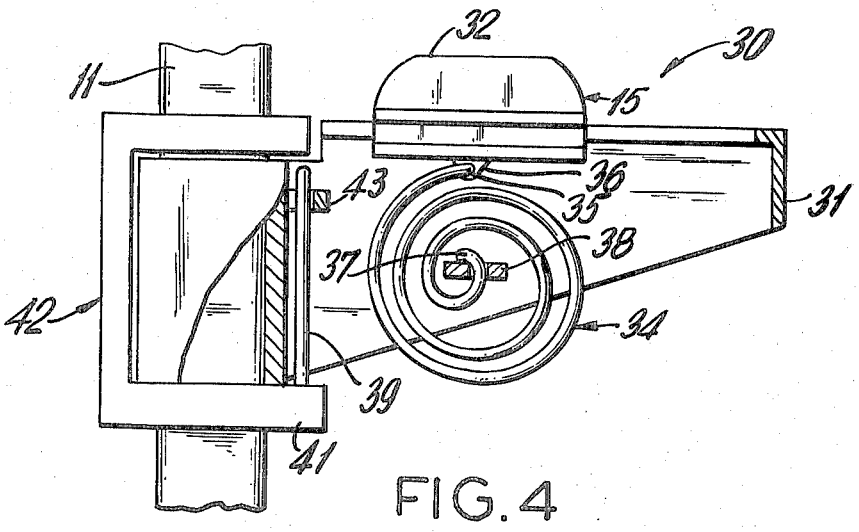
FIG. 4 is a cutaway side view of the saddle arrangement.
Figure 5:
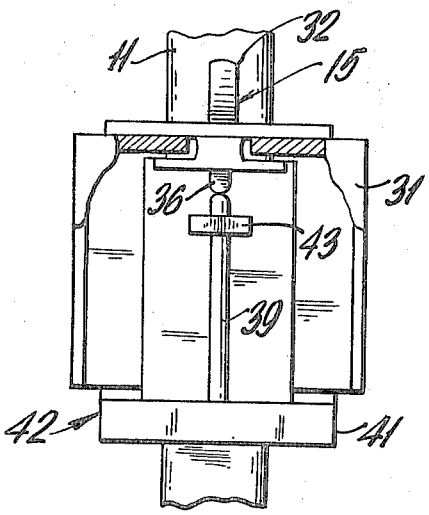
FIG. 5 is a cutaway front view of the saddle assembly.

FIG. 4 depicts the saddle assembly 30 mounted to the jack column 11 in a conventional ratchet-rack arrangement. The saddle 15 is keyed to the saddle support 31 but is free to move along it with the application of a predetermined force. The saddle 15 includes a protruding element 32 which fits into a slot into the bottom of the load and, typically the bumper when a vehicle is being lifted. The unstressed spiral spring 34 maintains the saddle 15 on the support 31 in a relaxed or initial position. The spring 34 is connected at one end 35 to a coupling 36 on the bottom of the saddle 15 and at the other end 37 to a portion 38 of the saddle support 31. The saddle 15 moves longitudinally on the support when a force beyond a certain limit is applied.

The support 31 is held in a relaxed or initial position by a straight wire spring 39 mounted to the base 41 of the frame 42. When the applied force causes the support 31 to rotate, the spring 39 is flexed to restrict such rotation. The spring 39 normally extends vertically upward from the frame 42 to engage the projecting portion 43 of the support 31. Once the force is removed the spring 34 returns the support 31 to its initial position.

During the operation of the jack 10, the two elements of lift point shift, magnitude and direction, force compensating motions of the saddle 15 and saddle support 31. Magnitude is accommodated by longitudinal movement of the saddle 31 on the support 15. Rotation of the support 31 about the column accommodates direction. The transient effects of extraneous impacts on lift point position are absorbed by the same compensating motions within reasonable limits.

Figure 6:
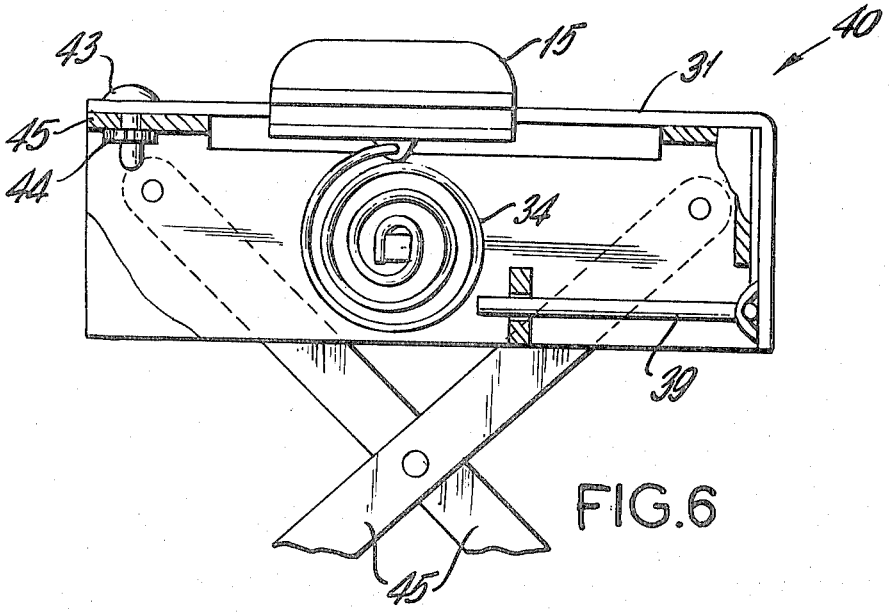
FIG. 6 is a cutaway side view of a jack saddle assembly for a scissor jack comprising an alternate embodiment of the invention.

An alternate embodiment of the invention comprising a jack saddle assembly 40 for a screw actuated scissor jack is shown in FIG. 6. The operation of the jack itself which relies upon pivotally mounted legs 45 however is conventional and hence will not be described in detail. The saddle 15 is keyed to the saddle support 31 in a manner which allows applied force to cause longitudinal motion of the saddle 15 on the support 31. The saddle support 31 is fastened to the assembly base 45 by the bolt 43 and C ring 44 in a manner which allows applied force to cause rotation of the support 31 on the base.

The unstressed spiral spring 34 mounted within the saddle base 45 maintains the saddle 15 in a relaxed initial position. Longitudinal motion of the saddle 15 on the support 31 will either compress or extend the spring 34 depending on the direction of the motion. Once the applied force is removed, the spring resiliency will return the saddle 15 to its initial position. The unflexed straight spring 34 holds the saddle support 31 on the saddle base 45 in the relaxed, initial position as shown.

When the applied force causes support rotation, the spring 39 is flexed. With force removal, spring resiliency returns the support 31 to the initial position.

As the jack is operated the two elements of lift point shift, magnitude and direction, force compensating motions of the saddle assembly. Magnitude is accommodated by longitudinal motion of the saddle 15 on the support 31. Rotation of the support on the base accommodates direction. The transient effects of extraneous impacts on lift point position are, within reasonable limits, absorbed and neutralized by the same compensating motions as in the previous embodiment.

Figure 7:
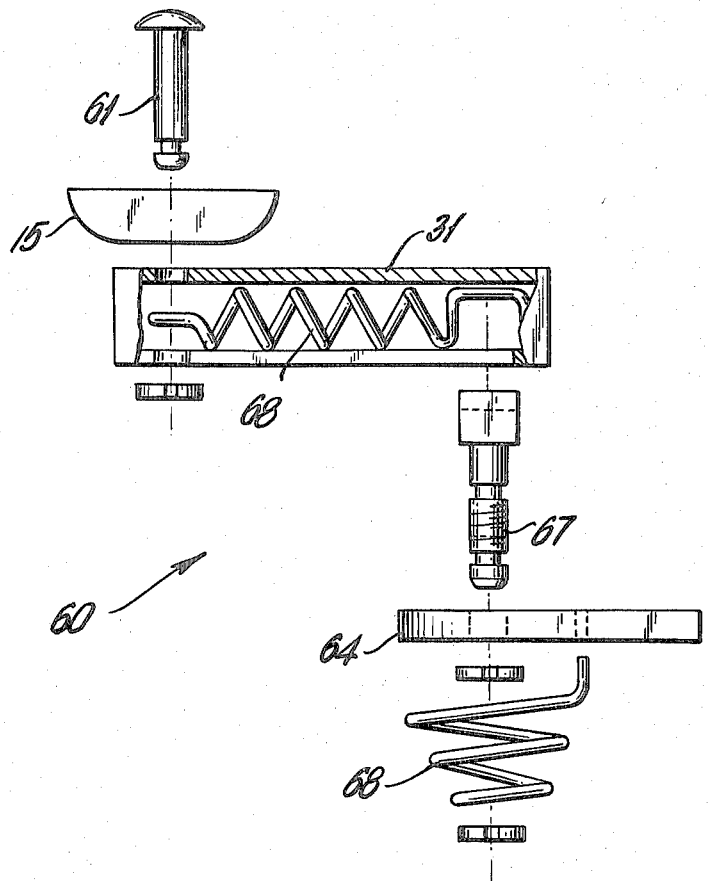
FIG. 7 is an exploded view of a novel floor jack saddle assembly including the present invention; and, FIG. 8*a* shows a collapsible wheel used in the floor jack design of FIG. 7.

An alternate embodiment of the invention included in a floor jack 60 is shown in FIG. 7. The saddle 15 is attached to the saddle support 31 by a bolt 61 and C ring 66. The saddle support 31 is attached to the assembly base 64 by a T headed bolt 67. The relative shapes of the support 31 and bolt 67 prevent rotation of the support 31 on the bolt 67. However, the relative shapes do allow applied force to cause longitudinal motion of the support 31 on the base 64. The unstressed coiled spring 68 maintains the support on the base in the relaxed, initial position. Longitudinal motion of the support on the base will either compress or extend the spring 68, depending on the motion direction. Once the applied force is removed, spring resiliency will return the support 31 to the initial position. Lateral force causes the support 31 and bolt 67 to rotate on the base 64. The unflexed spiral spring 68 holds the support on the base 64 in the relaxed, initial position. When applied force causes support rotation, the spring 68 is flexed. With force removal, spring resiliency returns the support 31 to the initial position.

As the jack is operated, the two elements of lift point shift, magnitude and direction, force compensating motions of the saddle assembly. Magnitude is accommodated by longitudinal motion of the saddle support on the assembly base. Rotation of the support on the base accommodates direction. The transient effects of extraneous impacts on lift point position are, within reasonable limits, absorbed and neutralized by the same compensating motions.

The total accommodation of the effects of lift point shift and extraneous impacts by the saddle assembly eliminates the need for wheels strong enough to support the combined weight of the jack and the vehicle. Wheel function is reduced to one of mobility since the wheels are designed to support the weight of the jack and to collapse or retract as the vehicle is raised. This affords a significant advantage on soft and uneven surfaces such as blacktop and gravel where the few square inches of contact between the surface and the jack wheel are replaced by the much larger area of a specially designed base plate 46 shown in FIG. 8*b*. Surface distortion and the resultant operational problems and safety hazards are eliminated, as are the problems and hazards of surface irregularities and debris.

Figure 8A:
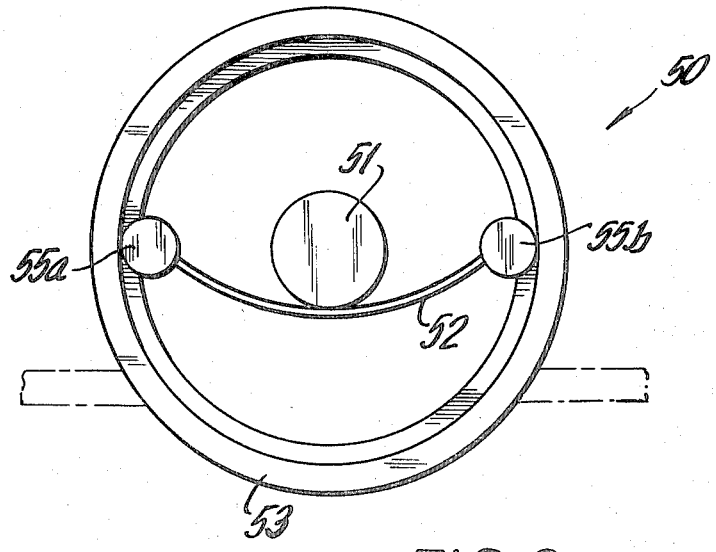
FIG. 8*b* shows the jack back plate used in conjunction therewith.
FIG. 8*c* shows an audible indicator arrangement used in the floor jack, and, FIG. 8*d* discloses a rotational limit indicator.

The novel collapsible wheel 50, shown in FIG. 8*a*, includes three basic component parts; namely, an axle 51, a leaf spring 52 and a rim 53. The axle 51 is fastened to the jack body in a manner which prevents rotation, while the spring 52 is fastened to the end of the axle 51 and is also prevented from rotating. The rim 53 is supported by, but free to rotate about the ends of the spring 52. A ridge on the inside of the rim locks the spring in place. The rollers 55*a–b* on the ends of the spring 52 are intended to minimize friction for improved operation.

Figure 8B:
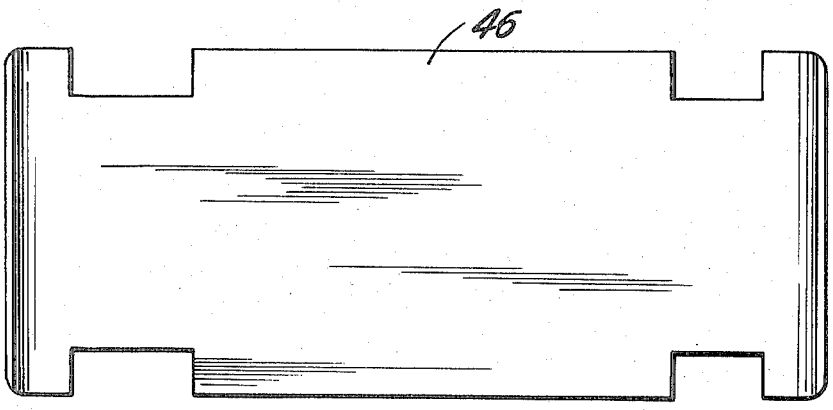

The length of the flat spring 52 is greater than the inner diameter of the rim 53. This causes the spring 52 to bow in the assembled wheel 50, and provides sufficient stress to support the weight of the jack. The addition of vehicle weight during jack operation causes the bowing to increase until the jack base plate 45 contacts the supporting surface. As the weight of the vehicle is removed, spring resiliency returns the wheel 50 to the jack support position. FIG. 8*b* illustrates a preferred jack base plate design. The base is made of steel with sufficient strength to support without distortion the combined weight of the jack and the raised vehicle. It is also possible in an alternate embodiment to provide a swivel caster (not shown) for use at the rear of the jack to improve maneuverability. The basic design would be the same as in the illustrated embodiment.

Figure 8C:
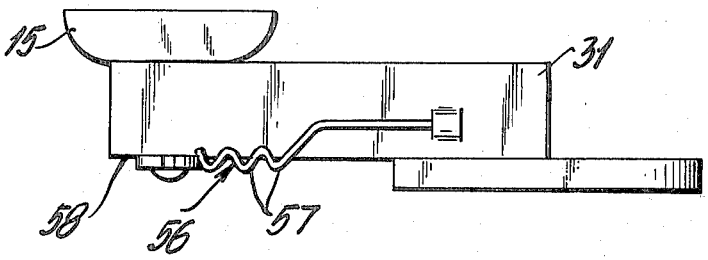

A further safety feature in a jack involves a means to indicate the operational limits of saddle motion. The preferred approach shown in the context of a floor jack is an audible indication which is shown in FIG. 8*c*. Accordingly, a serrated spring 56 is used to indicate the limit of longitudinal motion of the saddle 15 on the support 31. As the limit is approached, the serrations 57 come in contact with the assembly base. The result is a series of audible clicks as the spring serrations 57 engage the base 58.

Figure 8D:
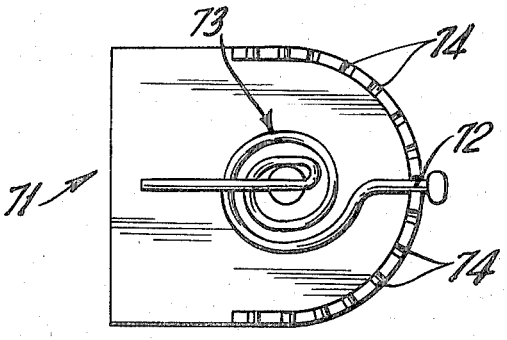

FIG. 8*d* shows a spring serration arrangement which audibly indicates the limit of lateral motion of the saddle support 31 on the assembly base 71. The end 72 of the spiral spring 73 which in FIG. 7 is fastened to the T-headed bolt 67 is extended to engage a series of notches 74 in the base edge. The spring 73 snaps into the notches 74 providing a sequence of audible clicks.

It is understood that the above-described arrangements are merely illustrative examples of the application. Numerous other arrangements may be readily devised by those skilled in the art which will embody the principles of the invention and fall within the scope and spirit thereof.

I claim:

1. A jack assembly for lifting unbalance loads comprising:

a base, a jack column mounted at one end on said base and extending vertically upwards therefrom, a collar mounted about an intermediate portion of the column, flexible support means pivotally mounted to the base at one end and coupled at the other end to the collar to prevent tilting of the column during lifting operations, said flexible support means comprising a plurality of rods curving inwardly towards the jack column and being pivotally mounted to the base at one end and wherein said collar includes apertures to accommodate said curved rods, a jack saddle assembly operatively connected to the column to engage the load for lifting purposes, and actuating means for driving said jack saddle on the column to lift the load.

2. A jack assembly for lifting unbalanced loads in accordance with claim 1 wherein:

said plurality of rods includes three rods, two of said rods being coupled in apertures in the collar and one of said rods being pivotally mounted to the column.

3. A jack assembly for lifting unbalanced loads comprising:

a base, a jack column mounted at one end on said base and extending vertically upwards therefrom, a collar mounted about an intermediate portion of the column, flexible support means pivotally mounted to the base at one end and coupled at the other end to the collar to prevent tilting of the column during lifting operations, a jack saddle assembly operatively connected to the column to engage the load for lifting purposes, and said jack saddle assembly comprising a frame operatively coupled to the column, a saddle support pivotally mounted thereto and extending outwardly therefrom, spring means mounted on the frame and engaging the saddle support to limit rotational movement thereof, a saddle mounted on said saddle support, a spiral spring mounted to the support and engaging the saddle to limit longitudinal movement along said support compensating for increases in the magnitude of force applied to the jack, actuating means for driving said jack saddle on the column to lift the load.

4. An apparatus in accordance with claim 3 wherein:

the jack saddle includes an upwardly projecting portion which is designed to engage an aperture in the load.

5. A jack assembly for lifting a load comprising:

means for engaging said load from beneath, actuating means coupled to said engaging means for driving the engaging means in an upward direction, and, wherein said engaging means comprises a base, a saddle support coupled to the base, a jack saddle mounted along the upper surface of said support and capable of movement with the application of a load, first spring means coupled between the jack saddle support and the base to resiliently oppose movement of the jack saddle and second spring means extending outwardly from the base within the saddle support and coupled to the saddle to restrain the rotational movement thereof when a load is applied.

6. A jack assembly for lifting a load comprising:

means for engaging said load from beneath, actuating means coupled to said engaging means for driving the engaging means in an upward direction, and, wherein said engaging means includes a jack saddle assembly coupled to the load and capable of translational and rotational movement to compensate for extraneous forces, said jack saddle assembly including a frame portion, a jack saddle slidably mounted thereon and spring means mounted within the frame and coupled to the saddle to resist movement thereof when a load is applied, and, the actuating means comprises crossed pivotal legs coupled to opposite ends of the frame and connected about a pivot point to one another to move said engaging means upwardly by a scissor action when the actuating means is operated.

7. A jack assembly for lifting a load comprising:

means for engaging said load from beneath comprising a platform, a hollow saddle support having spring means mounted therein and being located beneath the platform, a base mounted beneath the support and a bolt and C ring mounting connecting the platform support and base and permitting rotational movement thereof when a predetermined force is applied, actuating means coupled to said engaging means for driving the engaging means in an upward direction, and, wherein said engaging means includes a jack saddle assembly coupled to the load and capable of translational and rotational movement to compensate for extraneous forces.

8. A jack assembly for lifting a load comprising:

means for engaging said load from beneath, actuating means coupled to said engaging means for driving the engaging means in an upward direction, and, wherein said engaging means includes a jack saddle assembly coupled to the load and capable of translational and rotational movement to compensate for extraneous forces, and, a wheeled platform supporting the actuating and engaging means and having a base plate mounted to the bottom thereof and a plurality of wheels supporting the platform and an axle extending between each pair wherein each wheel includes a leaf spring mounted to the end of the axle and having a roller at each end of said spring to permit rotation of the wheels for jack mobility, and to permit the axle to descend with the weight of the load.

* * * * *